US009382802B2

(12) United States Patent
Dombek et al.

(10) Patent No.: US 9,382,802 B2
(45) Date of Patent: Jul. 5, 2016

(54) COMPRESSOR ROTOR

(75) Inventors: Christian Dombek, Lauchringen (DE); Mauro Corradi, Wettingen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 816 days.

(21) Appl. No.: 13/556,722

(22) Filed: Jul. 24, 2012

(65) Prior Publication Data

US 2013/0028750 A1 Jan. 31, 2013

(30) Foreign Application Priority Data

Jul. 26, 2011 (EP) ..... 11175451

(51) Int. Cl.
*F01D 5/08* (2006.01)
*F01D 25/08* (2006.01)

(52) U.S. Cl.
CPC *F01D 5/08* (2013.01); *F01D 5/081* (2013.01); *F01D 5/084* (2013.01); *F01D 25/08* (2013.01)

(58) Field of Classification Search
CPC ..... F01D 5/08; F01D 5/081; F01D 5/084; F01D 5/085; F01D 25/08; F01D 25/12; F05D 2260/209; F05D 2260/221
USPC ..... 415/1, 115; 416/90 R, 96 R
See application file for complete search history.

(56) References Cited

U.S. PATENT DOCUMENTS 4,348,157 A * 9/1982 Campbell et al. ..... 416/95
4,541,774 A 9/1985 Rieck et al.
4,719,747 A * 1/1988 Willkop et al. ..... 60/785
4,795,307 A * 1/1989 Liebl ..... 415/115
4,910,958 A 3/1990 Kreitmeier
6,406,263 B1 * 6/2002 Meacham et al. ..... 416/194
7,186,079 B2 * 3/2007 Suciu et al. ..... 415/199.5
7,524,168 B2 * 4/2009 Tschuor et al. ..... 416/97 R
2004/0030666 A1 * 2/2004 Marra et al. ..... 706/48
2005/0163612 A1 7/2005 Reigl
2006/0213202 A1 9/2006 Fukutani

FOREIGN PATENT DOCUMENTS

DE 2633222 A1 1/1978
DE 3116923 A1 4/1982

(Continued)

OTHER PUBLICATIONS

Office Action issued Oct. 5, 2015 by the German Patent Office in corresponding German Patent Application No. 10 2012 014 646.9, and a partial machine translation thereof.

*Primary Examiner* — Ninh H Nguyen
*Assistant Examiner* — Jesse Prager
(74) *Attorney, Agent, or Firm* — Buchanan Ingersoll & Rooney PC

(57) ABSTRACT

A compressor rotor is provided having a rotor blade groove thereon and also includes a device for cooling the rotor in the region of a compressor rotor exit. Efficient cooling is achieved by the compressor rotor, in a compressor rotor exit region, having a ring which is pushed concentrically, and at a distance, forming a gap, over a rotor disk of the rotor, and is fastened on the disk, by the rotor blades, in the compressor rotor exit region, being inserted into corresponding grooves on the ring and being retained there, by first means for directing an axial flow of cooling medium from the compressor rotor exit through the ring, and by second means for deflecting the cooling medium which issues from the ring such that the cooling medium flows back in the axial direction through the gap between the ring and the rotor disk, encompassed by the ring.

18 Claims, 2 Drawing Sheets

(56) References Cited

FOREIGN PATENT DOCUMENTS

| | | | |
|---|---|---|---|
| DE | 3736836 | A1 | 5/1989 |
| EP | 0313826 | A1 | 5/1989 |
| EP | 0690202 | A2 | 1/1996 |
| EP | 0799971 | B1 | 10/1997 |
| GB | 1541533 | A | 3/1979 |
| GB | 2350408 | A | 11/2000 |
| WO | 2009071910 | A1 | 6/2009 |

* cited by examiner

COMPRESSOR ROTOR

RELATED APPLICATIONS

This application claims benefit under 35 U.S.C. §119 to European Patent Application No. 11175451.1, filed Jul. 26, 2011. The entire contents of which are incorporated by reference herewith as if fully set forth.

FIELD OF THE INVENTION

The present invention relates to the field of turbomachines. It refers to a compressor rotor; to a gas turbine comprising such a rotor; and to a method for cooling a gas turbine having such a rotor.

BACKGROUND

FIG. 1 shows the basic schematic layout of a gas turbine, as is used as a stationary industrial turbine, for example, for generating power. The gas turbine 10 of FIG. 1 comprises a compressor 12 which via an air intake 11 inducts and compresses combustion air. The compressed air is introduced into a combustion chamber 13 and used there for combusting a fuel 14. The ensuing hot gases are expanded in a subsequent turbine 15, performing work, and are discharged to the outside as exhaust gas 16 or put to further use in a heat recovery steam generator.

The rotor blades which are required for the compressor 12 and the turbine 15 are usually attached on a rotor 17 which has corresponding rotor disks. In the compressor 12, during compression of the combustion air, temperatures of more than 100° C. occur at the compressor exit. Cooling of the rotor in this region on the one hand reduces in this case the thermal loading of the materials which are used but on the other hand can also be conducive to altogether improving the efficiency of the gas turbine. For the cooling, some of the compressed air can be tapped off, cooled down in a cooling device 18 (dashed lines in FIG. 1), and can then be fed into the exit region of the compressor 12 for cooling purposes.

In printed publication EP 0 799 971 B1, it has been proposed, for protection of the rotor against a thermal overload in the exit region of the compressor, to provide a thermal barrier which reduces the entry of heat from the compressor passage into the rotor body. In this case, however, it involves a purely passive measure which does not enable dissipation of the heat.

From GB 2 350 408 A, it is also known—in the case of the rotor of a turbomachine—to arrange a concentric annular thermal shield element at a distance around the rotor, which thermal shield element carries the rotor blades and reduces the entry of heat into the rotor. In addition, a cooling medium can flow through a gap between the ring and the rotor, which dissipates heat. In this case, it is disadvantageous that the shield element, for want of separate cooling, makes particular demands upon the material. Furthermore, cooling medium, which flows through beneath the shield elements, can be fed back only into the compressor, as a result of which the compressor discharge temperature rises. Furthermore, this cooling medium is no longer available for the combustion chamber or for turbine cooling.

The present-day design at the exit of the compressor, beyond which the invention extends, according to FIG. 2 comprises compressor blades 21 which are fastened in circumferential grooves 20' on the rotor 17 or on the rotor disk 25'. In most industrial gas turbines, some of the compressed compressor air is tapped off and instead of being supplied to the combustion is used as cooling air of hot parts (rotor, hot gas parts). In order to improve the efficiency of the cooling, some of the compressor air is sent through a cooler in order to achieve a lower temperature of the cooling medium (see above). In the case of the gas turbine of FIG. 2, some of this precooled cooling air 24 is fed back to the exit of the compressor 12 via (stationary) structural parts 23' of a center section 19 which adjoins the compressor 12 downstream. The cooling air in this case is used for purging the cavity 22 between the compressor rotor exit and the center section 19 and also as cooling air for the rotor disk 25' in the region of the compressor rotor exit. It is the aim to lower the rotor temperature in this region with the cooling air.

Although it is the aim to lower the rotor temperature in this region with the cooling air, this type of cooling is not efficiently adequate for the rotor disk 25'. In order to increase the output and therefore the efficiency in a gas turbine, the combustion temperature and/or the mass flow can be increased. An output increase can be achieved by means of an improved compressor. This results in a higher mass flow so that the pressure and therefore the air temperature at the exit of the compressor increase and consequently the rotor temperature also rises. With higher rotor temperature in the region of the compressor rotor exit, however, the service life of the rotor is negatively influenced.

SUMMARY

The present disclosure is directed to a compressor rotor, including at least one groove for accommodating rotor blades and a device for cooling the compressor rotor in a region of the compressor rotor exit. The compressor rotor, in the region of the compressor rotor exit, has a ring which is pushed concentrically, and at a distance, forming a gap, over a rotor disk of the compressor rotor, and is fastened on the rotor disk. The ring has grooves for accommodating rotor blades in the region of the compressor rotor exit. Provision is made for first means for directing an axial flow of cooling medium from the compressor rotor exit through the ring. Provision is also made for second means for deflecting the cooling medium which issues from the ring in such a way that the cooling medium flows back in the axial direction through the annular gap between the ring and the rotor disk, which is encompassed by the ring.

The present disclosure is also directed to a gas turbine including a compressor, a combustion chamber, a turbine and a rotor. The rotor includes the above described compressor rotor.

The present disclosure is further directed to a method for cooling a compressor rotor of a gas turbine. The gas turbine includes a compressor, a combustion chamber and a turbine. The compressor has a multiplicity of rotor blades which are inserted into corresponding grooves on a compressor rotor, as described above, and are retained there. The method includes directing a cooling medium from the compressor exit through the first means of the ring. The method also includes deflecting the cooling medium by the second means and directing the cooling medium back in the axial direction through the gap between the ring and the rotor disk, which is encompassed by the ring.

BRIEF DESCRIPTION OF THE DRAWINGS

The invention shall subsequently be explained in more detail based on exemplary embodiments in conjunction with the drawing. In the drawings.

DETAILED DESCRIPTION OF THE PREFERRED EMBODIMENTS

Introduction to the Embodiments

Figure 1:
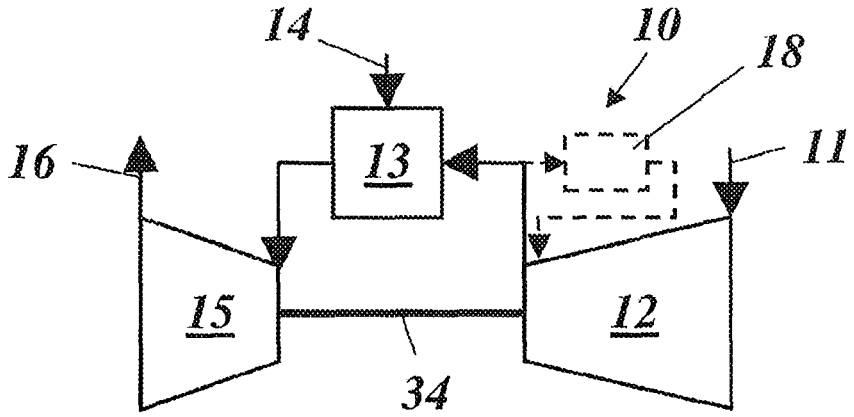
FIG. 1 shows the basic schematic arrangement of a gas turbine, as is suitable for realization of the invention.
Figure 2:
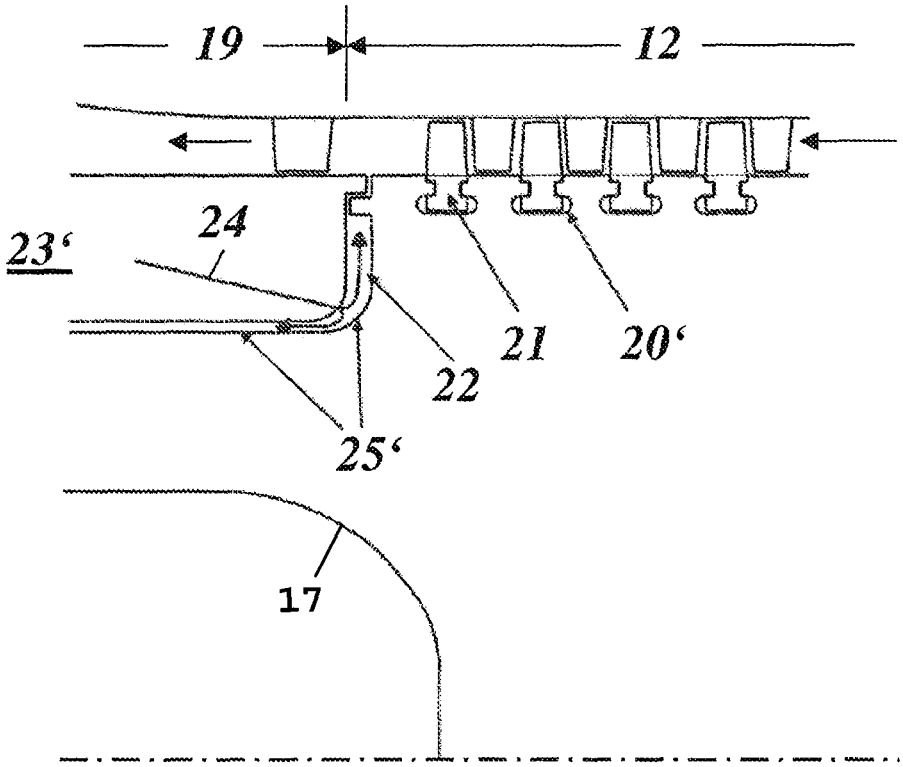
FIG. 2 shows a longitudinal section through a gas turbine in the region of the compressor rotor exit with cooling, as has been used up to now.

It is therefore an object of the invention to disclose a rotor which avoids the described disadvantages of previous rotors and which is especially distinguished by the fact that with a comparatively simple construction the thermal loading of the rotor at the compressor rotor exit is significantly reduced.

The rotor according to the invention, which is especially intended for use in a gas turbine, comprises a rotor, which has at least one groove into which a multiplicity of rotor blades on the rotor can be inserted and can be retained there, and also a device for cooling the rotor in the region of the compressor rotor exit. In the invention, the rotor, in the region of the compressor rotor exit, has a ring which is pushed concentrically, and at a distance, forming a gap, over a rotor disk of the rotor, and is fastened on the rotor disk, in that the rotor blades, in the region of the compressor rotor exit, are inserted into corresponding grooves on the ring and retained there, in that provision is made for first means for directing an axial flow of cooling medium from the compressor rotor exit through the ring, and in that provision is made for second means for deflecting the cooling medium which issues from the ring in such a way that the cooling medium flows back in the axial direction through the gap between the ring and the rotor disk, which is encompassed by the ring. The gap between the ring and the rotor disk, which is encompassed by the ring, has the shape of an annular gap, for example, wherein this can be interrupted by fastening elements which connect the ring to the rotor disk.

In one embodiment of the compressor according to the invention the first means comprises a multiplicity of axial holes in a distributed arrangement over the circumference of the ring, through which flows the cooling medium.

In another embodiment of the compressor according to the invention the second means comprise an annular deflection region which is formed in the rotor disk and is in communication with the first means or axial holes and with the gap between the ring and the rotor disk and brings about a reversal of the flow direction of the cooling medium.

According to another embodiment, the ring is fastened on the rotor disk by means of a form fit between the inner generated surface of the ring and the outer generated surface of the rotor disk.

The form fit is typically designed in the style of radially oriented inverted-T connections or fir-tree root connections which are distributed over the circumference.

In a further embodiment of the invention the ring, by the upstream-disposed end face, butts against an annular stop face of the rotor disk, and the ring and the rotor disk are interconnected in this region.

The connection between the ring and the rotor disk can be effected in this case by means of a form fit.

It is also conceivable, however, that the connection between the ring and the rotor disk is effected by a material bond, especially by means of welding.

In addition to the compressor rotor, a gas turbine, comprising a compressor, a combustion chamber, a turbine and a rotor, is a subject of the invention, the rotor (34) comprising a compressor rotor (17) according to one of the above-described embodiments.

In one embodiment of the gas turbine according to the invention the ring, in the installed state, is arranged on the downstream-disposed end face next to stationary structural parts, and the cooling medium is used for cooling the compressor rotor exit via the structural parts.

Deflection elements are preferably arranged at the transition between the structural parts and the ring and impose a swirl in the rotational direction of the compressor upon the cooling medium which issues from the structural parts.

The deflection elements can especially be designed as baffle plates.

It is just as easily conceivable, however, that the deflection elements are designed as swirl nozzles.

According to a further embodiment of the invention, at least one seal is arranged between the structural parts and the ring.

The seal can especially be designed as a labyrinth seal or brush seal.

According to one embodiment, such a seal is attached on a radius which is smaller than the distance from the center of the rotor to the first means for directing an axial flow of cooling medium through the ring. This seal prevents a bypass of the cooling medium around the ring.

According to one embodiment, such a seal is attached on a radius which is larger than the distance from the center of the rotor to the first means for directing an axial flow of cooling medium through the ring. This seal prevents a backflow of cooling medium into the main flow of the compressor.

In addition to the compressor rotor and the gas turbine, a method for cooling a compressor rotor of an above-described gas turbine according to the invention is a subject of the invention. In this case, the gas turbine comprises a compressor, a combustion chamber and a turbine. The compressor itself has a multiplicity of rotor blades which are inserted into corresponding grooves on a compressor rotor and are retained there. Furthermore, the compressor rotor, in the region of the compressor rotor exit, has a ring which is pushed concentrically, and forming a gap, over a rotor disk of the compressor rotor, and is fastened on the rotor disk, wherein the rotor blades, in the region of the compressor rotor exit, are inserted into corresponding grooves on the ring and are retained there. Furthermore, provision is made in the ring for first means for directing an axial flow of cooling medium from the compressor rotor exit through the ring and provision is made for second means for deflecting the cooling medium which issues from the ring. In the method a cooling medium from the compressor exit is directed through the first means of the ring, the cooling medium is then deflected by the second means, and the cooling medium is finally directed back in the axial direction through the gap between the ring and the rotor disk, which is encompassed by the ring.

According to one embodiment of the method, a swirl is imposed upon the cooling medium before it is introduced into the first means of the ring.

All the explained advantages can be applied not only in the respectively disclosed combinations but also in other combinations or in isolation without departing from the scope of the invention. For example, the compressor rotor, which is described based on the example of a gas turbine with a compressor, a combustion chamber and a turbine, can equally be used for gas turbines with sequential combustion, i.e. gas turbines which comprise a compressor, or a plurality of compressors, a first combustion chamber, a high-pressure turbine, a second combustion chamber (sequential combustion chamber) and a low-pressure turbine. Accordingly, a gas turbine with sequential combustion and the rotor according to the invention and a method for cooling a compressor rotor for a gas turbine with sequential combustion are also covered within the scope of the invention.

DETAILED DESCRIPTION

In order to improve the cooling in the region of the compressor rotor exit, according to the present invention a cooling circuit is created beneath the high-pressure compressor or compressor rotor exit by means of a separate ring.

Figure 3:
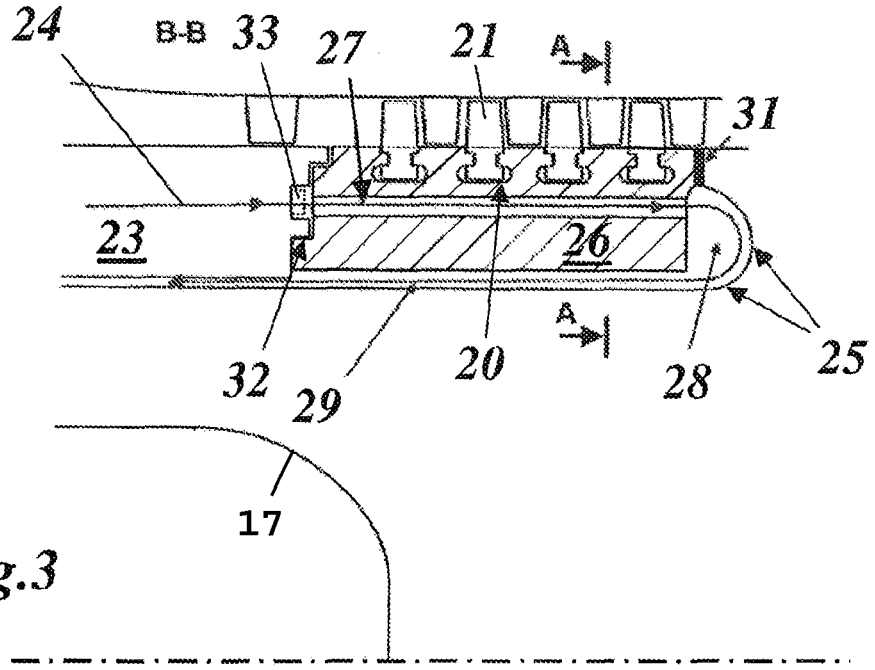
FIG. 3 shows in a view comparable to FIG. 2 a compressor exit with improved cooling according to an exemplary embodiment of the invention.
Figure 4:
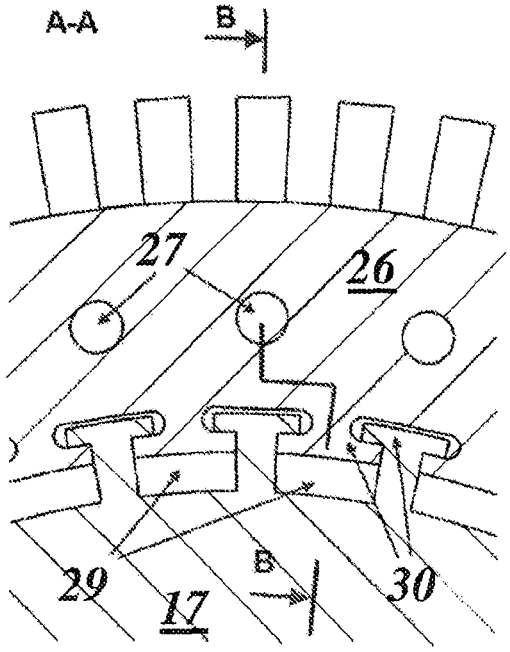
FIG. 4 shows the cross section in the plane A-A through the compressor according to FIG. 3.

As becomes clear from FIG. 3, the ring 26 is pushed onto the rotor disk 25 during manufacture. The connection between the ring 26 and the rotor disk 25 can be carried out in different ways. On the one hand, according to FIG. 4, a form fit 30 between the opposite generated surfaces of the ring 26 and the rotor disk 25 can be used, the form fit especially having the form of a radially oriented inverted-T connection which is distributed over the circumference.

On the other hand, the possibility exists of connecting the upstream-disposed end face of the ring 26 to the adjacent stop face 31 of the rotor disk 25 also via a form fit, or via a material bond (particularly by means of welding). Self-locking is also provided during operation because with the rotor 17 in motion the thrust of the ring 26 is directed against the stop face 31.

The cooling air 24 is guided through the structural parts 23 of the center section to the cavity at the exit of the compressor 17. From the cavity, the cooling air finds its way into axial holes 27 in the ring 26 which are in a distributed arrangement over the circumference of the ring 26. At the upstream-disposed end of the ring 26, the cooling air which issues from the ring 26 is deflected in a deflection region (by 180°) and finds its way through the gap 29 between the rotor disk 25 and the ring 26 in the direction of the turbine again.

Between the ring 26 and the structural parts 23 of the center section 19, provision is preferably made for a seal 32 in order to minimize slight leakage. This seal can be, for example, a conventional labyrinth seal or brush seal.

In order to minimize the entry losses of the cooling air into the ring 26, provision can be made at the outlet of the cooling air from the structural parts 23 for deflection elements 33, especially in the form of a swirl nozzle or baffle plates, which impose a swirl in the rotational direction of the compressor upon the cooling air which issues from the structural parts 23.

As a result of the gap 29 between the ring 26 and the rotor 17, the contact face between said ring 26 and rotor 17 is also reduced. This reduces the conduction of heat from the hot ring 26 into the rotor 17.

Overall, features of the invention include:

The system uses cooled compressor air which is supplied via the secondary system.

The number of blades in the compressor 12 is freely selectable because circumferential grooves are provided in the separate ring 26 as before.

The separate ring 26, depending upon the fixing via form fit or material bond, can consist of a material which is different from the rotor disk 25.

Axial holes 27 through the ring 26 enable a flow of cooling air through the ring 26 and cooling of said ring 26.

A feedback of the cooling air in the case of the form-fit connection is provided.

A double seal system ensures that the different cooling air flows are separated from each other.

The cooling air, after flowing through the ring 26, can be put to further use for cooling the combustion chamber or turbine.

LIST OF DESIGNATIONS

10 Gas turbine
11 Air intake
12 Compressor
13 Combustion chamber
14 Fuel
15 Turbine
16 Exhaust gas
17 Compressor rotor
18 Cooling device (external)
19 Center section
20, 20' Groove (circumferential)
21 Rotor blade
22 Cavity
23, 23' Structural part
24 Cooling air
25, 25' Rotor disk
26 Ring
27 Axial hole
28 Deflection region
29 Gap
30 Form fit
31 Stop face
32 Seal
33 Deflection element (e.g. baffle plate, swirl nozzle)
34 Rotor

What is claimed is:

1. A compressor rotor, comprising:

at least one groove for accommodating rotor blades;

in a region of the compressor rotor exit, a ring which is pushed concentrically, and at a distance, forming a gap, over a rotor disk of the compressor rotor, and fastened on the rotor disk, the ring having grooves for accommodating rotor blades in the region of the compressor rotor exit;

a plurality of axial holes in a distributed arrangement over a circumference of the ring, through which flows a cooling medium for directing an axial flow of the cooling medium from the compressor rotor exit through the ring; and an annular deflection region formed in the rotor disk and in communication with the axial holes and with the annular gap between the ring and the rotor disk for deflecting the cooling medium which issues from the ring in such a way that the cooling medium flows back in the axial direction through the annular gap between the ring and the rotor disk for bringing about a reversal of a flow direction of the cooling medium.

2. The compressor rotor as claimed in claim 1, wherein the ring is fastened on the rotor disk by a form fit between an inner generated surface of the ring and an outer generated surface of the rotor disk.

3. The compressor rotor as claimed in claim 1, wherein the ring, by an upstream-disposed end face, butts against an annular stop face of the rotor disk, and the ring and the rotor disk are interconnected in this region.

4. The compressor rotor as claimed in claim 3, wherein the connection between the ring and the rotor disk is effected by a form fit.

5. The compressor rotor as claimed in claim 3, wherein the connection between the ring and the rotor disk is effected by welding.

6. A gas turbine, comprising:

a compressor;

a combustion chamber;

a turbine; and a rotor, the rotor including a compressor rotor having at least one groove for accommodating rotor blades, and in a region of the compressor rotor exit;

a ring which is pushed concentrically, and at a distance, forming a gap, over a rotor disk of the compressor rotor, and is fastened on the rotor disk, the ring having grooves for accommodating rotor blades in the region of the compressor rotor exit;

a plurality of axial holes in a distributed arrangement over a circumference of the ring, through which flows a cooling medium for directing an axial flow of the cooling medium from the compressor rotor exit through the ring; and an annular deflection region formed in the rotor disk and in communication with the axial holes and with the annular gap between the ring and the rotor disk for deflecting the cooling medium which issues from the ring in such a way that the cooling medium flows back in the axial direction through the annular gap between the ring and the rotor disk for bringing about a reversal of a flow direction of the cooling medium.

7. The gas turbine as claimed in claim 6, wherein the ring is arranged on a downstream-disposed end face directly next to stationary structural parts, and the cooling medium is used for cooling the compressor rotor exit via the structural parts.

8. The gas turbine as claimed in claim 7, comprising:

deflection elements arranged at a transition between the structural parts and the ring for imposing a swirl in the rotational direction of the compressor upon the cooling medium which issues from the structural parts.

9. The gas turbine as claimed in claim 8, wherein the deflection elements are designed as baffle plates.

10. The gas turbine as claimed in claim 8, wherein the deflection elements are designed as swirl nozzles.

11. The gas turbine as claimed in claim 6, wherein a seal is arranged between the structural parts and the ring.

12. A method for cooling a compressor rotor of a gas turbine, wherein the gas turbine includes a compressor, a combustion chamber and a turbine, and the compressor has a multiplicity of rotor blades which are inserted into corresponding grooves on a compressor rotor and are retained there, the compressor rotor, in a region of the compressor rotor exit, has a ring which is pushed concentrically, and forming a gap, over a rotor disk of the compressor rotor, and is fastened on the rotor disk, and the rotor blades, in the region of the compressor rotor exit, are inserted into corresponding grooves on the ring and are retained there, and a plurality of axial holes in a distributed arrangement over a circumference of the ring, through which flows a cooling medium for directing an axial flow of the cooling medium from the compressor rotor exit through the ring and an annular deflection region formed in the rotor disk and in communication with the axial holes and with the annular gap between the ring and the rotor disk for deflecting the cooling medium which issues from the ring, the method comprising:

directing a cooling medium from the compressor exit through the plurality of axial holes of the ring;

deflecting the cooling medium by the annular deflection region, and directing the cooling medium back in the axial direction through the gap between the ring and the rotor disk to bring about a reversal of a flow direction of the cooling medium.

13. The method as claimed in claim 12, further comprising:

imposing a swirl upon the cooling medium before it is introduced into the means for directing of the ring.

14. The compressor rotor as claimed in claim 1, wherein the rotor is formed of a single piece extending radially from an axis of rotation to a flow path of the compressor.

15. The compressor rotor as claimed in claim 1, wherein the ring extends over at least two compressor stages.

16. The compressor rotor as claimed in claim 1, wherein the means for directing an axial flow of cooling medium from the compressor rotor exit through the ring directs the flow of cooling medium in a first direction and the means for deflecting the cooling medium which issues from the ring in such a way that the cooling medium flows back in the axial direction through the annular gap between the ring and the rotor disk deflects the cooling medium in a second direction opposite from the first direction.

17. The gas turbine according to claim 6, wherein the ring extends over at least two compressor stages.

18. The method for cooling a compressor rotor according to the method as claimed in claim 12, wherein the ring extends over at least two compressor stages.

* * * * *